United States Patent [19]

Obermüller

[11] 4,362,031

[45] Dec. 7, 1982

[54] MULTIPARTITE JEWELRY ITEM USEFUL AS A FINGER RING

[75] Inventor: Hermann Obermüller, Schenkenzell, Fed. Rep. of Germany

[73] Assignee: Gebr. Niessing, Ureden, Fed. Rep. of Germany

[21] Appl. No.: 169,722

[22] Filed: Jul. 17, 1980

[30] Foreign Application Priority Data

Jul. 27, 1979 [DE] Fed. Rep. of Germany ..... 2930500

[51] Int. Cl.[3] ..... A44C 9/00

[52] U.S. Cl. ..... 63/15; 63/10; 46/1 R

[58] Field of Search ..... 63/15, 5 A, 11, 10, 63/3, 15.45, 15.5, 6, 9, 2, 1 R; 59/79.1; 46/1 R

[56] References Cited

U.S. PATENT DOCUMENTS

| | | | |
|---|---|---|---|
| Re. 25,163 | 4/1962 | Manne | 63/15.45 |
| D. 40,321 | 10/1909 | Beetar | 63/2 UX |
| 234,093 | 11/1880 | Untermeyer | 63/1 R |
| 243,793 | 7/1881 | Richards | 63/11 |
| 309,525 | 12/1884 | Corbin | 63/9 |
| 895,078 | 8/1908 | Döppenschmitt | 63/11 X |
| 1,525,005 | 2/1925 | Sherman | 63/1 R |
| 1,565,651 | 12/1925 | Klass et al. | 63/15.7 |
| 1,972,128 | 9/1934 | Bobbroff | 63/15.3 |
| 1,978,168 | 10/1934 | Reid | 63/3 |
| 2,738,616 | 3/1956 | Windle | 46/1 R |
| 2,902,749 | 9/1959 | Manne | 63/15.45 |
| 3,628,351 | 12/1971 | Chernow | 63/15.5 |
| 3,900,984 | 8/1975 | Garelick | 46/1 R |

FOREIGN PATENT DOCUMENTS

| | | | |
|---|---|---|---|
| 352255 | 7/1928 | Belgium . | |
| 51663 | 5/1936 | Denmark | 63/1 R |
| 4378 | 8/1878 | Fed. Rep. of Germany | 63/3 |
| 5524 | 6/1879 | Fed. Rep. of Germany . | |
| 231464 | 2/1911 | Fed. Rep. of Germany . | |
| 1162117 | 1/1964 | Fed. Rep. of Germany . | |
| 435226 | 12/1911 | France . | |
| 446266 | 9/1912 | France . | |
| 455952 | 6/1913 | France . | |
| 348 | of 1909 | United Kingdom . | |

*Primary Examiner*—F. Barry Shay

*Attorney, Agent, or Firm*—Toren, McGeady & Stanger

[57] ABSTRACT

A multipartite item of jewelry particularly useful as a finger ring formed of a plurality of sections which are flexibly connected to each other in order to form a closed series of curves with the sections being constructed with a circular configuration.

7 Claims, 3 Drawing Figures

MULTIPARTITE JEWELRY ITEM USEFUL AS A FINGER RING

The present invention relates generally to items of jewelry and more particularly to a multipartite or composite piece of jewelry which is particularly useful as a finger ring.

Jewelry items made in composite or multipartite form in the shape of a ring, particularly composite finger rings are known in the art with the rings being closed in themselves and combined in the position of use to form a joint piece of jewelry. Examples of such prior art items are disclosed in German Offenlegungsschrift No. 19 12 690 and U.S. Pat. No. 1,327,606. However, in rings of a known construction, each individual ring remains in the form of a ring which is closed in itself. Such items can either be worn separately, as in the case of the aforementioned German reference, or the item may be combined into a unit, as is the case in the aforementioned U.S. patent.

The present invention is directed toward provision of a solution through which a composite ring may be provided with ring components which may be moved relative to each other and wherein different configurations may be obtained by a user of a piece of jewelry without affecting the unity of the item itself.

SUMMARY OF THE INVENTION

Briefly, in accordance with the present invention, an item of jewelry is formed to be structured from a plurality of sections which are flexibly connected to each other and which are arranged to form a closed series of curves.

As a result of the construction in accordance with the present invention, the item of jewelry may be used, by way of example, as a ring through which scarves or similar items may be passed in order that the ring may function as a decorative article of apparel. Because the ring components are movable relative to each other they may be arranged in appropriate shapes to suit different applications. Simultaneously, when the item is in the configuration of a ring, the piece of jewelry may be adjusted to a limited extent to different finger sizes because of the flexible connections which are provided between the individual sections of the item.

In one advantageous embodiment of the invention, the sections are constructed as circular ring sections. This embodiment may be advantageously utilized as a finger ring because it is possible in a simple manner to obtain a double or multiple ring arrangement with the rings intersecting at one location or at several locations thereby creating a special jewelry effect.

Additionally, a series of curves forming, for example, the shape of a FIG. 8 may be worn on two fingers simultaneously either by the same person or as a ring for partners worn by different persons.

In accordance with the invention, it is provided that the sections are constructed as tubular pieces which are connected through an elastic element which extends within the tubular pieces. The elastic connections at the contact points between the sections forming the series of curves may, in principle, be constructed as elastic connections and accordingly, the structure in accordance with the invention is particularly advantageous and useful if the type of flexible connection is not visible from the exterior of the item in order thereby not to negatively affect the overall impression created by the ring.

In this regard, it is particularly advantageous to structure the elastic element in a spiral form in accordance with a further feature of the invention. This facilitates a comparatively simple assembly inasmuch as after the individual sections have been threaded onto the spiral form, the two ends of the spiral may be connected together in a simple manner with means readily available to a goldsmith.

In a further embodiment of the invention, it is provided that the item of jewelry is formed of four arc sections of 180°. Furthermore, in a modified embodiment of the invention, eight arc sections of 90° may be provided wherein essentially circular arc sections are contemplated. Of course, other arc portions or sections are also conceivable.

In accordance with the invention, the aesthetic value and overall impression of the item of jewelry are enhanced in that the arc sections are each constructed differently with respect to color and/or surface composition. Furthermore, each arc section may be in itself designed with different colors and/or jewelry stone settings or the like may be arranged between the sections.

By way of example, small spheres of metal of different colors such as coral, pearl or the like may be arranged between the sections.

In addition to the features mentioned above which particularly influence the aesthetic overall impression of the jewelry item, other possibilities and configurations are also possible within the scope of the invention.

For example, the item of jewelry may be made of a number of arc sections such that a ring can be formed which wraps around 3, 4 or more times wherein there is always provided a closed series of curves.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
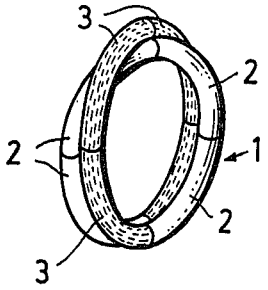
FIG. 1 is a perspective view showing a finger ring in accordance with the present invention twisted in a counterclockwise manner and folded on itself.
Figure 3:
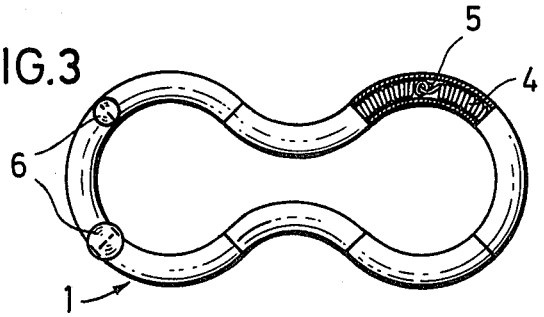
FIG. 3 is a partially sectioned view showing the item of jewelry in accordance with the invention in the untwisted form depicted as consisting of eight tubular curved elements, with one of the elements shown in section.

Referring now to the drawing wherein like reference numerals are used to refer to similar parts in the various FIGURES thereof, there is illustrated an item of jewelry 1 which is composed, by way of example, of four differently adjoining sections of the same color as depicted in FIG. 1. The sections of the jewelry item 1 may, for example, be of precious metal, in the form of quarter circle sections 2 and adjoining circle sections 3 may be of another color, the sections being constructed as tubular elements and being held together by an elastic element which, as best illustrated in FIG. 3, is in the form of a spiral spring 4. The spiral spring 4, in turn, is joined together at eyes 5 in order to form a closed spring, as will be seen particularly in the sectional view of FIG. 3.

Figure 2:
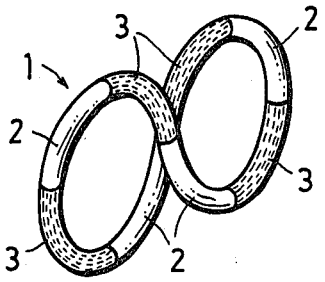
FIG. 2 is a perspective view showing another configuration of the item of jewelry in accordance with the present invention arranged for use as a two-finger ring.

In FIG. 2 there is depicted a possibility for altering the ring sections 2 and the ring sections 3 and combining them into a series of curves. Due to the fact that the individual ring sections 2, 3 are elastically connected to one another, the invention not only makes it possible to obtain the configurations illustrated in the figures of the drawing but it also enables the creation of other articles of jewelry. More particularly, with tubular sections of different sizes, other three-dimensional bodies may be created which may be formed, for example, as rings for kerchiefs, rings for partners, articulated rings (which could also be rings to be worn on joints) or the like. FIG. 3 further shows the possibility for threading, for example, of pearls 6 between the sections 2 and 3.

Of course, it will be understood that the embodiments described herein may be modified in various ways without departing from the basic concept of the invention. It is to be understood that the invention is particularly not intended to be limited to the connection by means of a spiral spring. For example, elastic materials such as rubber or the like may be utilized for the connections in a similar manner. Additionally, the ring can obviously also be formed in a single color or in several colors in addition to the two colors which are illustrated.

Moreover, each ring may be designed with several colors and also additional supports for gems can be inserted in the joints. Also the sections themselves can be provided with gems so that also in this case different aesthetic and color impressions can be created.

While specific embodiments of the invention have been shown and described in detail to illustrate the application of the inventive principles, it will be understood that the invention may be embodied otherwise without departing from such principles.

What is claimed is:

1. A multipartite item of jewelry particularly useful as a finger ring comprising: eight hollow tubular sections each formed as a circular arc subtending an angle of 90° arranged together end-to-end to form an overall endless closed loop, the ends of each of said sections being movable relative to the ends of each adjacent section to enable said sections to be turned relative to each other; and flexible means resiliently holding said curved sections together in the form of said overall endless closed loop while enabling said sections to be turned end-to-end relative to each other; said flexible means enabling said overall endless closed loop to be twisted upon itself to form said jewelry item into a smaller closed loop formed of two generally overlapping circular segments while maintaining the ends of adjacent sections in abutting contact; said overall endless closed loop having a circumferential dimension which is at least twice as large as the circumferential dimension of said smaller closed loop formed therefrom.

2. An item according to claim 1 wherein gem settings are arranged over abutting ends of said hollow tubular sections to cover the separating lines therebetween.

3. An item according to claim 1 wherein gem settings are provided in said sections.

4. An item according to claim 1 wherein said flexible means comprise an elastic element extending continuously on the interior of said hollow tubular sections to join said sections together.

5. An item according to claim 4 wherein said elastic element is constructed in a spiral configuration.

6. An item according to claim 1 wherein said sections are structured to be different with respect to color.

7. An item according to claim 1 wherein said sections are structured to be different with respect to surface composition.

* * * * *